US007333751B2

(12) United States Patent
Gumbe

(10) Patent No.: US 7,333,751 B2
(45) Date of Patent: Feb. 19, 2008

(54) ELECTROPHOTOGRAPHIC PROCESS UNIT AND IMAGE FORMING APPARATUS

(75) Inventor: Eiji Gumbe, Kanagawa-ken (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 355 days.

(21) Appl. No.: 11/206,854

(22) Filed: Aug. 19, 2005

(65) Prior Publication Data

US 2007/0041744 A1 Feb. 22, 2007

(51) Int. Cl.
*G03G 15/00* (2006.01)

(52) U.S. Cl. ..... 399/110; 399/111; 399/112

(58) Field of Classification Search ..... 399/62, 399/64, 112; 248/599, 601, 653, 673, 677, 248/83

See application file for complete search history.

(56) References Cited

U.S. PATENT DOCUMENTS

2004/0190932 A1* 9/2004 Ishii ..... 399/110

FOREIGN PATENT DOCUMENTS

JP 09-190134 A 7/1997
JP 09-236959 A 9/1997

* cited by examiner

*Primary Examiner*—David M. Gray
*Assistant Examiner*—David A Blackshire
(74) *Attorney, Agent, or Firm*—Foley & Lardner LLP

(57) ABSTRACT

According to the present invention, when inserting and removing EPUs from an image forming unit, a support leg of a casing can swing, is inclined, and avoids easily a structural body on a path. Further, when putting the EPUs outside the main body of the image forming apparatus, the support leg is fixed to the casing. Therefore, the space for the support leg of the casing of the image forming unit to insert through can be reduced.

36 Claims, 7 Drawing Sheets

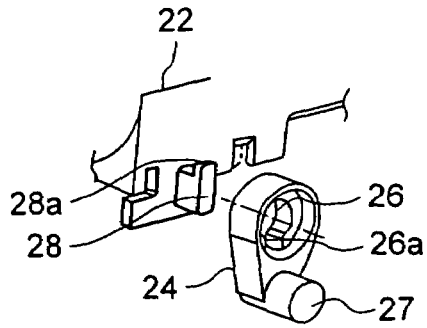
FIG. 3-2
FIG. 10-1
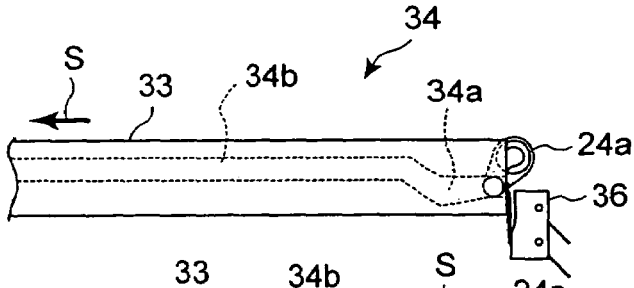
FIG. 10-2
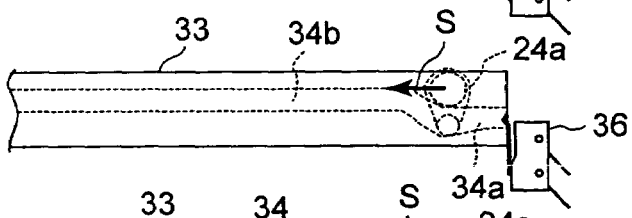
FIG. 10-3
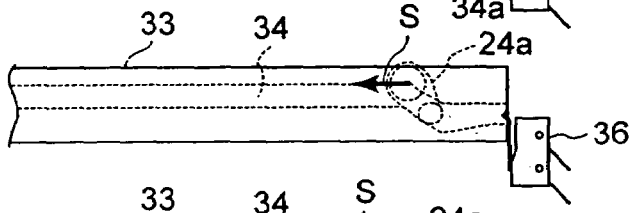
FIG. 10-4
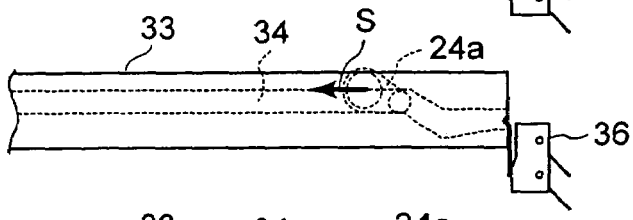
FIG. 10-5
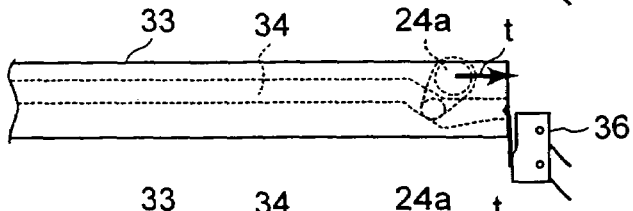
FIG. 10-6
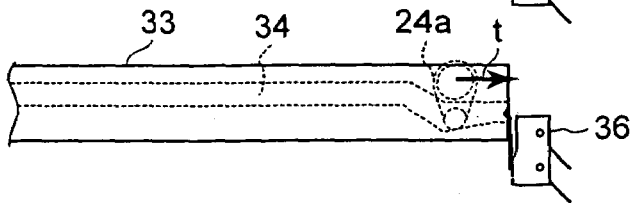

ELECTROPHOTOGRAPHIC PROCESS UNIT AND IMAGE FORMING APPARATUS

FIELD OF THE INVENTION

The present invention relates to an electro-photographic process unit removably attached to a copier or a printer for forming images by the electro-photographic method and an image forming apparatus.

DESCRIPTION OF THE BACKGROUND

In recent years, in an image forming apparatus of the electro-photographic method such as a copier or a printer, there is an apparatus using an electro-photographic process unit (hereinafter abbreviated to EPU) integrally incorporated with a photosensitive drum and a main charger or a cleaner around the photosensitive drum which can be attached removably to the apparatus body. The EPU, when taken out from the apparatus body at time of maintenance, is put on the workbench around the apparatus body. At this time, to prevent the bottom of the EPU from touching directly the workbench or tools placed in the neighborhood of the workbench, conventionally, there is an apparatus in which the housing of the EPU is equipped with fixed legs.

Particularly, in an EPU equipped with a developing device and a toner density sensor at the bottom, when the EPU equipped with legs on the housing is put on the workbench around the apparatus body, the toner density sensor is prevented from touching the workbench or tools on the workbench and being damaged.

On the other hand, in recent years, further miniaturization of the image forming apparatus is required and it is also required to make the components themselves of the image forming apparatus smaller and reduce the spaces between the components. As a result, the space around the EPU is restricted and in the neighborhood of the EPU, it is necessary to closely arrange a laser optical unit for exposing a photosensitive drum and a transfer unit.

However, if the space around the EPU is reduced like this, when inserting or removing the EPU from the apparatus body, it is interrupted by the legs fixed to the housing. Therefore, although the housing is made smaller, around the EPU, it is necessary to provide a space for inserting the legs of the housing, thus it is an obstacle to miniaturization of the image forming apparatus.

Therefore, in the image forming apparatus using the EPU inserted or removed from the apparatus body, an electro-photographic process unit for, when putting the EPU on the workbench outside the apparatus body, preventing the bottom of the EPU from touching the workbench, reducing the space for passing the housing legs when inserting or removing the EPU from the apparatus body, thereby realizing further miniaturization of the image forming apparatus and an image forming apparatus are desired.

SUMMARY OF THE INVENTION

Therefore, an effect of the present invention, in the image forming apparatus using the EPU, is to reduce the space for passing the housing legs of the EPU and realize miniaturization of the main body of the image forming apparatus.

To accomplish the above effect, according to the embodiment of the present invention, there is provided An electro-photographic process unit comprising: an image carrying member on which a toner image is formed; a case member removably attached to a main body of an image forming apparatus to support the image carrying member; and at least one leg member provided on the case member, rotatable when the case member is mounted in the main body of the image forming apparatus and fixed when the case member is put on a loading face outside the main body of the image forming apparatus, to support the case member.

BRIEF DESCRIPTION OF THE DRAWINGS

FIG. 3-1 is a schematic perspective view showing the developing device of the EPU of the embodiment of the present invention;

FIG. 3-2 is an exploded schematic perspective view showing the support leg and bracket of the embodiment of the present invention;

FIG. 5-1 is an illustration showing the raised EPU state viewed from the side of the embodiment of the present invention;

FIG. 5-2 is an illustration showing the support leg when the EPU of the embodiment of the present invention is raised;

FIG. 6-1 is an illustration showing the state viewed from the side that the EPU of the embodiment of the present invention is put on the workbench;

FIG. 6-2 is an illustration showing the support leg when the EPU of the embodiment of the present invention is put on the workbench;

FIG. 10-1 is an illustration showing the position of the grounding section on the rear when the EPU of the embodiment of the present invention is mounted on the image forming unit;

FIG. 10-2 is an illustration showing the position of the grounding section on the rear in the rear area when the EPU of the embodiment of the present invention is pulled out from the image forming unit;

FIG. 10-3 is an illustration showing the inversion of inclination of the support leg in the rear area when the EPU of the embodiment of the present invention is pulled out from the image forming unit;

FIG. 10-4 is an illustration showing the inclination of the support leg in the opposite area when the EPU of the embodiment of the present invention is pulled out from the image forming unit;

FIG. 10-5 is an illustration showing the inclination of the support leg in the rear area when the EPU of the embodiment of the present invention is mounted on the image forming unit;

FIG. 10-6 is an illustration showing the state that the grounding section reaches the lowest end in the rear area when the EPU of the embodiment of the present invention is mounted on the image forming unit;

FIG. 11-1 is an illustration showing the state viewed from the side that the EPU of the embodiment of the present invention is inserted into the image forming unit;

FIG. 11-2 is an illustration showing the support leg when the EPU of the embodiment of the present invention is inserted into the image forming unit.

DETAILED DESCRIPTION OF THE EMBODIMENTS

Figure 1:
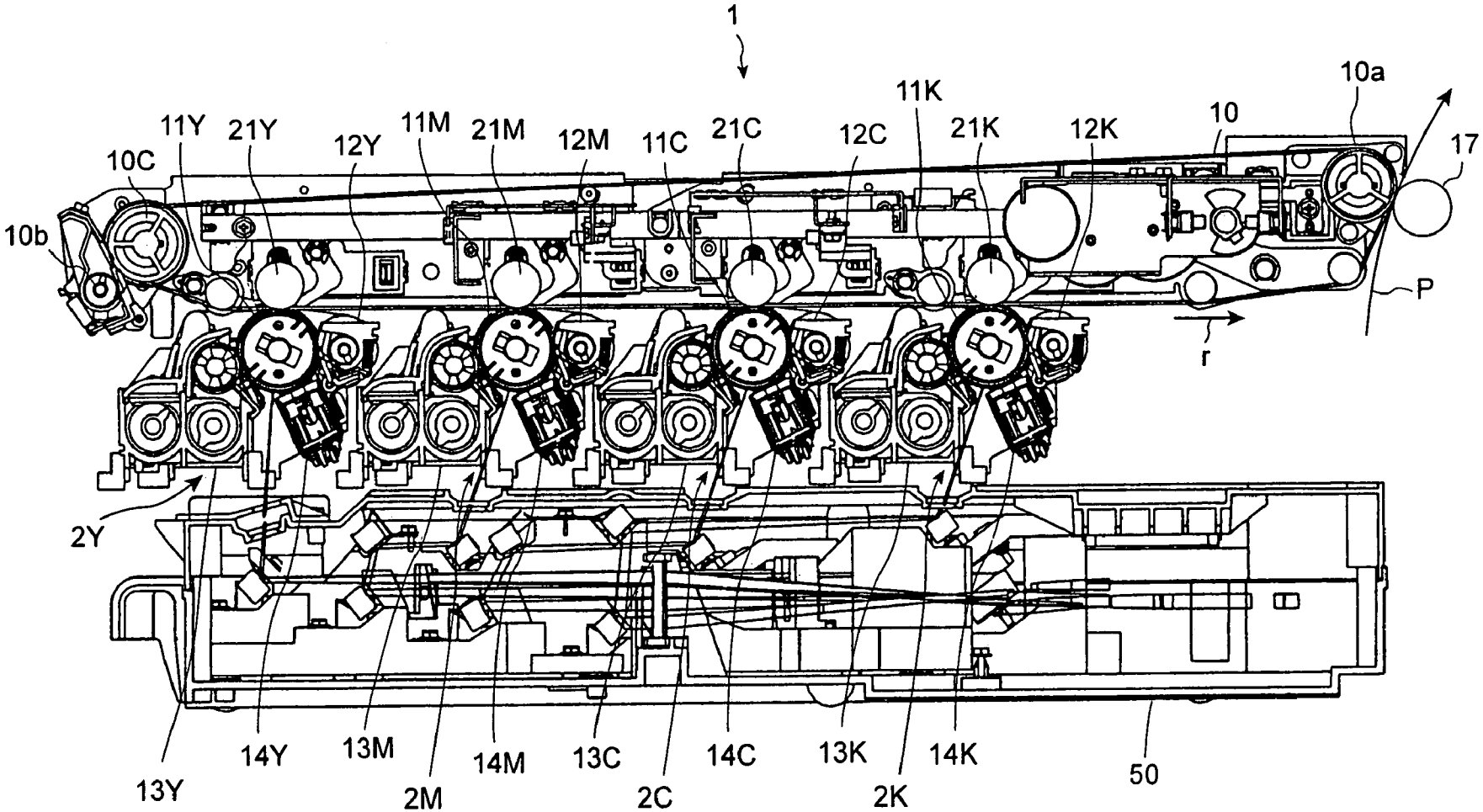
FIG. 1 is a schematic block diagram showing the image forming unit of the color copier of the embodiment of the present invention.

The embodiment of the present invention will be explained in detail with reference to the accompanying drawings. FIG. 1 is a schematic block diagram showing image forming unit 1 installed in the main body of the color copier of the 4-each tandem method which is an embodiment of the present invention and an image forming apparatus. Image forming unit 1 has four EPUs 2Y, 2M, 2C and 2K of yellow (Y), magenta (M), cyan (C) and black (K) which are arranged in parallel along the lower side of intermediate transfer belt 10. EPUs 2Y, 2M, 2C and 2K shown in FIG. 2 can be mounted and demounted from image forming unit 1.

EPUs 2Y, 2M, 2C and 2K respectively have photosensitive drums 11Y, 11M, 11C and 11K which are image carrying members. To the primary transfer positions of intermediate transfer belt 10 opposite to photosensitive drums 11Y, 11M, 11C and 11K, a primary transfer voltage is applied by primary transfer rollers 21Y, 21M, 21C and 21K and toner images on photosensitive drums 11Y, 11M, 11C and 11K are primarily transferred to the intermediate transfer belt.

Intermediate transfer belt 10 is stretched and suspended by drive roller 10*c* and secondary transfer opposite roller 10*a*, and to the secondary transfer position where secondary transfer roller 17 and secondary transfer opposite roller 10*a* are arranged opposite to each other, a secondary transfer voltage is applied by secondary transfer roller 17 via sheet of paper P, and a toner image on intermediate transfer belt 10 is secondarily transferred to sheet of paper P. On the downstream side of secondary transfer roller 17 of intermediate transfer belt 10, belt cleaner 10*b* is installed.

In EPUs 2Y, 2M, 2C and 2K, around photosensitive drums 11Y, 11M, 11C and 11K, in the rotational direction of arrow m, chargers 14Y, 14M, 14C and 14K which are charging members, developing devices 13Y, 13M, 13C and 13K which are developing members, and photoconductor cleaners 12Y, 12M, 12C and 12K which are cleaning members are arranged. Between chargers 14Y, 14M, 14C and 14K around photosensitive drums 11Y, 11M, 11C and 11K and developing devices 13Y, 13M, 13C and 13K, exposure light is irradiated by laser exposure device 50 which is an exposing member. Chargers 14Y, 14M, 14C and 14K, laser exposure device 50, developing devices 13Y, 13M, 13C and 13K, and photoconductor cleaners 12Y, 12M, 12C and 12K around photosensitive drums 11Y, 11M, 11C and 11K compose an image forming mechanism.

Next, the structure of EPUs 2Y, 2M, 2C and 2K will be described in detail. EPUs 2Y, 2M, 2C and 2K have the same structure, so that the common numerals will be used for explanation. As shown in FIGS. 2 to 5-3, on the bottom of housing 22 of each of EPUs 2Y, 2M, 2C and 2K, auto-toner sensor 23, for example, for magnetically detecting the toner density of developing devices 13 is projected. Further, in the four corners of the side of the bottom of housing 22 of each of EPUs 2Y, 2M, 2C and 2K, support legs 24 which are leg members are attached rotatably.

Figure 2:
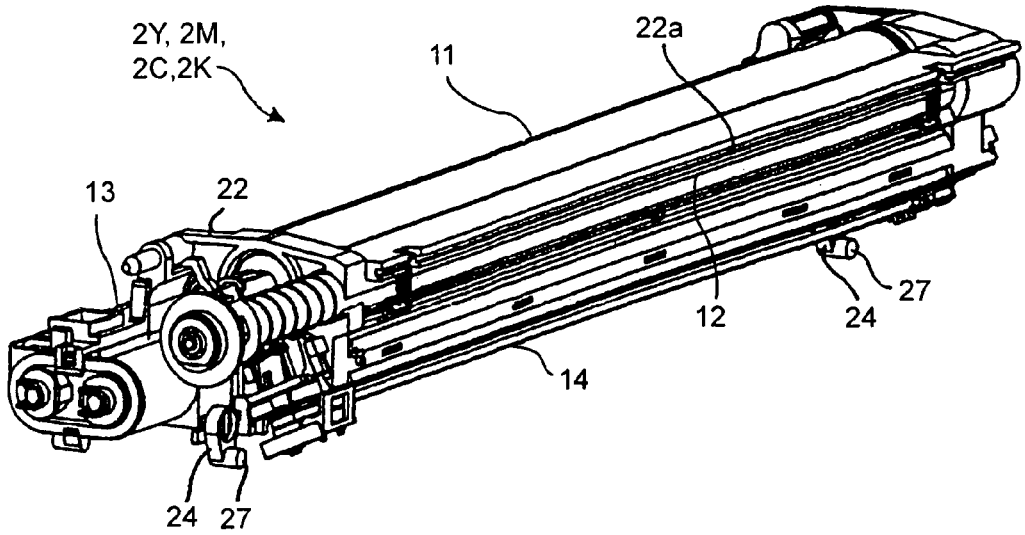
FIG. 2 is a perspective view showing the EPU of the embodiment of the present invention.
Figures 1, 3:
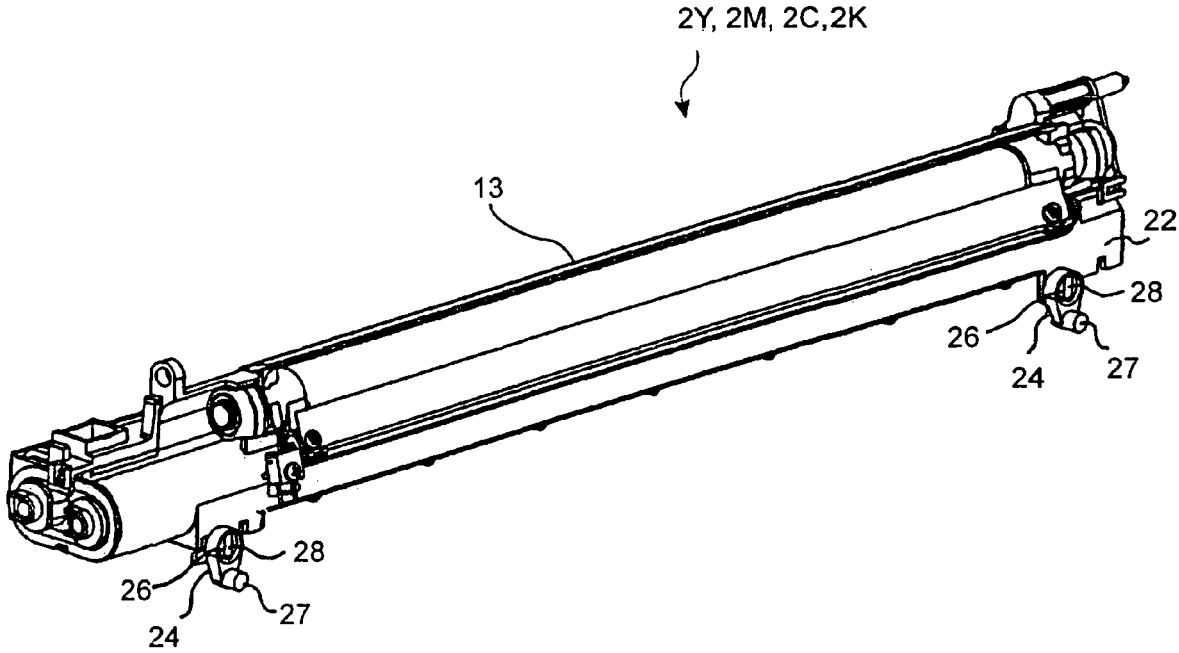
Figures 1, 5:
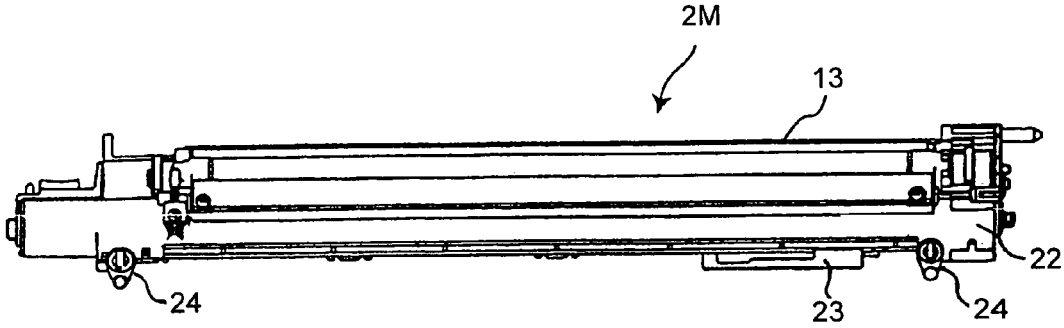
Figures 2, 5:
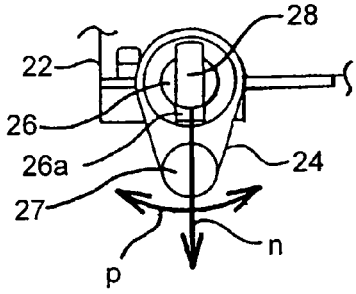

As shown in FIG. 3-2, on support leg 24, keyhole-shaped fitting hole 26 and columnar grounding section 27 are formed. To the side of housing 22, oval bracket 28 which is a mounting member is fixed. Support leg 24, after bracket 28 is inserted through fitting hole 26, is attached to housing 22. As shown in FIG. 5-1, when EPUs 2Y, 2M, 2C and 2K are raised and support leg 24 is lifted up, as shown in FIG. 5-2, the load of housing 22 is not applied to support leg 24. Further, grounding section 27 of support leg 24 is positioned downward by its own weight. Namely, to support leg 24, its own weight is applied in the direction of arrow n, and fitting hole 26 is not restricted by bracket 28, thus support leg 24 can swing in the direction of arrow p.

Figures 1, 6:
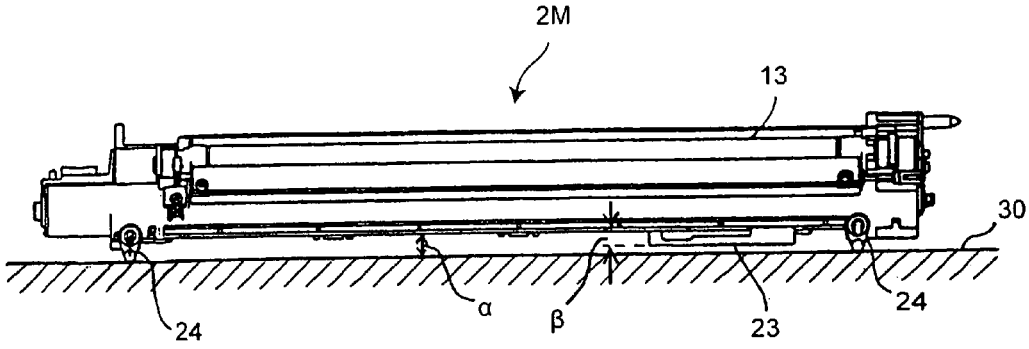
Figures 2, 6:
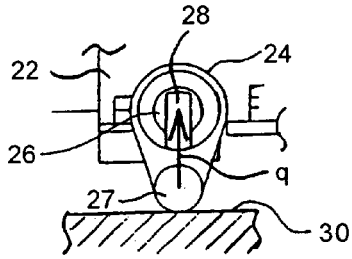

On the other hand, when EPUs 2Y, 2M, 2C and 2K, are taken out from image forming unit 1 and as shown in FIG. 6-1, are put on workbench 30 such as a desk which is a loading face outside the main body of the image forming apparatus, to support legs 24 loaded on workbench 30, the load of housing 22 is applied and support legs 24 loaded on workbench 30, as shown in FIG. 6-2, slide in the direction of arrow q for EPUs 2Y, 2M, 2C and 2K. At this time, bracket 28 is fit into slit 26*a* of fitting hole 26 and support legs 24 are restricted in the swing thereof and are fixed.

Further, on the main body side of the image forming apparatus, first stay 31 and second stay 32 for supporting EPUs 2Y, 2M, 2C and 2K are installed. Furthermore, on the main body side of the image forming apparatus, when necessary, rail 33 which is a guide member for guiding grounding section 27 of support legs 24 at time of inserting or removing EPUs 2Y, 2M, 2C and 2K is installed.

Into first slit 22*a* formed in housing 22 of EPUs 2Y, 2M, 2C and 2K, first stay 31 is inserted and into second slit 22*b* formed in housing 22, second stay 32 is inserted. Therefore, when EPUs 2Y, 2M, 2C and 2K are mounted in image forming unit 1 of the image forming apparatus, the weight of housing 22 is not applied to support legs 24 and support legs 24 can swing in the direction of arrow p.

Rail 33, when inserting or removing EPUs 2Y, 2M, 2C and 2K from image forming unit 1, is used to smoothly avoid laser exposure device 50 installed on the path of support legs 24. Namely, as shown in FIG. 1, support legs 24 of EPU 2Y do not interfere with laser exposure device 50 under them, so that rail 33 is not required. On the other hand, in EPU 2M, since only support leg 24 on the right interferes with laser exposure device 50, rail 33 for guiding support leg 24 on the right is necessary only for support leg 24 on the right. Furthermore, in EPUs 2C and 2K, support legs 24 on the right and left interfere with laser exposure device 50, so that rail 33 is necessary for support legs on the right and left.

Next, rail 33 in EPU 2M will be described in detail. As shown in FIGS. 4 and 7 to 9, in image forming unit 1, rail 33 which is a guide member for guiding right rear grounding section 27*a* and right front grounding section 27*b* of right support leg 24 of EPU 2M is installed.

Right rear grounding section 27*a* and right front grounding section 27*b* of housing 22 can be fit into slit 34 of rail 33. Slit 34, in opposite area 34*a* to laser exposure device 50, is formed along the top of laser exposure device 50 and in rear area 34*b* after passing laser exposure device 50, is equipped with a level difference for inverting the inclination direction of support legs 24.

Figure 7:
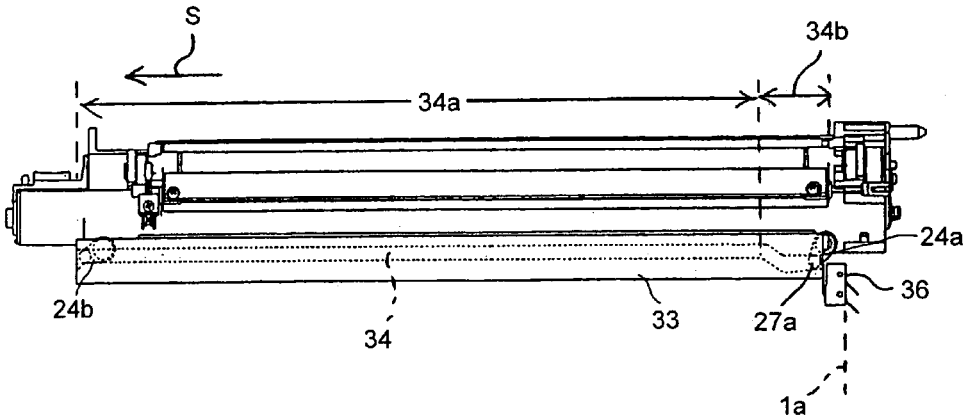
FIG. 7 is an illustration showing the state viewed from the side that the EPU of the embodiment of the present invention is mounted on the image forming unit.
Figure 8:
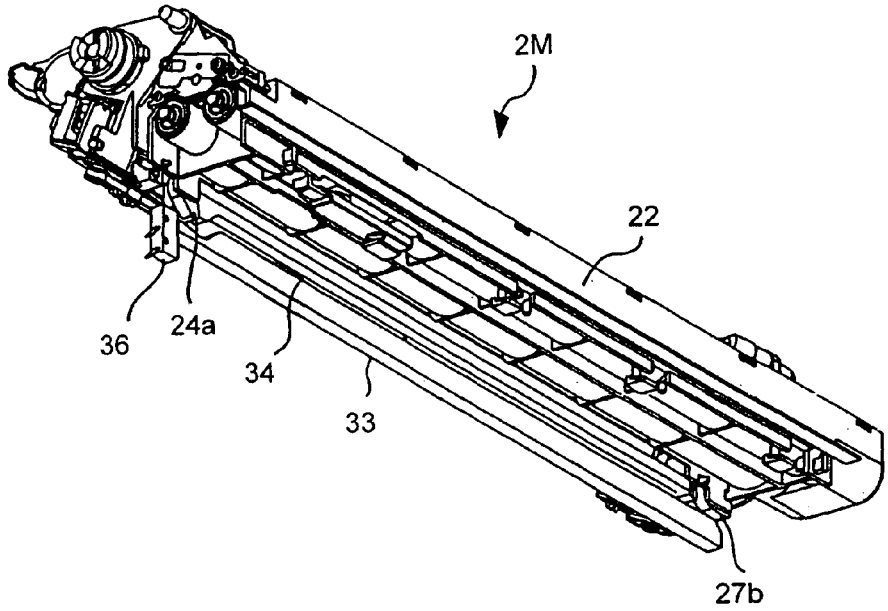
FIG. 8 is an illustration showing the state on the rear of the image forming unit viewed from underneath that the EPU of the embodiment of the present invention is mounted on the image forming unit.
Figure 9:
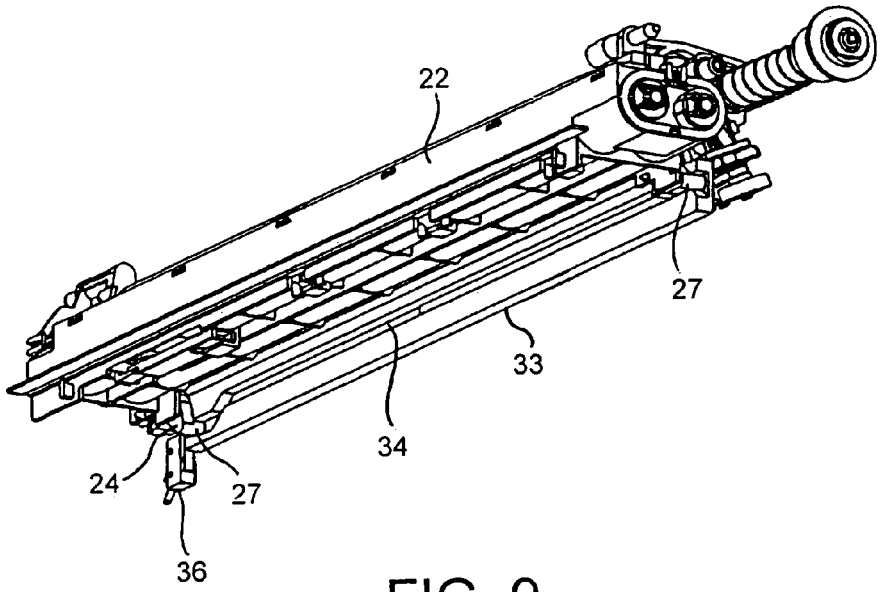
FIG. 9 is an illustration showing the state on the front of the image forming unit viewed from underneath that the EPU of the embodiment of the present invention is mounted on the image forming unit.

Further, in EPUs 2C and 2K, rail 33 having slit 34, to guide grounding section 27 of right and left support legs 24, is installed on the right and left of housing 22. Further, as shown in FIG. 7, on rear frame 1*a* of image forming unit 1, a mounting detection switch 36 which is a mounting detection member switched by arrival of grounding section 27 when EPUs 2Y, 2M, 2C and 2K are mounted in image forming unit 1 is installed. Image forming unit 1 will not be driven unless mounting detection switch 36 is switched.

Next, the operation of the invention will be described. In EPUs 2Y, 2M, 2C and 2K mounted in image forming unit 1, housing 22 is supported by first and second stays 31 and 32, so that if no interference mechanism exists under support legs 24, the weight of housing 22 is not applied originally to support legs 24. Namely, support legs 24 can swing in the direction of arrow p shown in FIG. 5-2.

For example, in EPU 2M, left support leg 24 shown in FIG. 1 does not interfere with laser exposure device 50, so that grounding section 27 is positioned downward by its own weight and can swing in the direction of arrow p shown in FIG. 5-2. However, right rear grounding section 27*a* and right front grounding section 27*b* of right support leg 24 shown in FIG. 1 interfere with laser exposure device 50, so that they cannot swing. Actually, right rear grounding section 27*a* and right front grounding section 27*b* of right support leg 24 shown in FIG. 1 are guided by rail 33 and respectively stand still at the positions shown in FIG. 7. Further, apparatus detection switch 36 is switched by right rear grounding section 27*a* of right support leg 24 shown in FIG. 1 and detects that EPUs 2Y, 2M, 2C and 2K are mounted in image forming unit 1.

When the image forming operation is started and image information is input from a scanner or a personal computer terminal, photosensitive drums 11Y, 11M, 11C and 11K of EPUs 2Y, 2M, 2C and 2K are rotated in the direction of arrow m and the image forming step is sequentially executed. In EPU 2Y of yellow (Y), the surface of photosensitive drum 11Y is uniformly charged by charger 14Y and then is irradiated with a laser beam corresponding to the yellow (Y) image information from laser exposure device 50, and an electrostatic latent image is formed. Furthermore, photosensitive drum 11Y forms a toner image by developing device 13Y, makes contact with intermediate transfer belt 10 rotating in the direction of arrow r, and primarily transfers the toner image onto intermediate transfer belt 10 by primary transfer roller 21Y.

Similarly to the yellow (Y) toner image forming process, the toner image forming process of magenta (M), cyan (C) and black (K) is performed. The toner images formed on photosensitive drums 11M, 11C and 11K are sequentially transferred to the position on intermediate transfer belt where the yellow (Y) toner image is formed and a full-color toner image is formed on intermediate transfer belt 10. Hereafter, the full-color toner image on intermediate transfer belt 10 reaches the position of secondary transfer roller 17 and is secondarily transferred onto sheet of paper P in a batch.

Hereafter, sheet of paper P passes the fixing step and the toner image is completed. Intermediate transfer belt 10, after end of the secondary transfer, is cleaned residual toner by belt cleaner 10*b*. Further, photosensitive drums 11Y, 11M, 11C and 11K, after primarily transferring the toner images to intermediate transfer belt 10, are removed residual toner by photoconductor cleaners 12Y, 12M, 12C and 12K and wait for the next image forming process.

During execution of this image forming process, when EPUs 2Y, 2M, 2C and 2K require maintenance, any of EPUs 2Y, 2M, 2C and 2K requiring maintenance is pulled out from image forming unit 1. For example, when EPU 2M is supported by first and second stays 31 and 32, EPU 2M is pulled out from the mounting position in image forming unit 1 shown in FIG. 7 in the direction of arrow s. At this time, left support leg 24 of EPU 2M shown in FIG. 1, since grounding section 27 moves down by its own weight as shown in FIG. 5-2, is pulled out swingably in the direction of arrow s. Right front support leg 24*b* of EPU 2M shown in FIG. 1 is guided by rail 33 at the slope shown in FIG. 7 and is pulled out in the direction of arrow s.

On the other hand, right rear support leg 24*a* of EPU 2M shown in FIG. 1 is guided by rail 33 in the state shown in FIG. 7 and is pulled out in the direction of arrow s while changing the inclination direction. Namely, when EPU 2M is pulled out in the direction of arrow s in the mounting state shown in FIG. 10-1, grounding section 27*a* reaches the lowest end of support legs 24 as shown in FIG. 10-2 along the shape of the level difference of rear area 34*b* of slit 34. Next, as shown in FIG. 10-3, grounding section 27*a* is guided along the shape of slit 34 and support leg 24 inverts the inclination so that grounding section 27*a* remains on the rear side.

Figure 4:
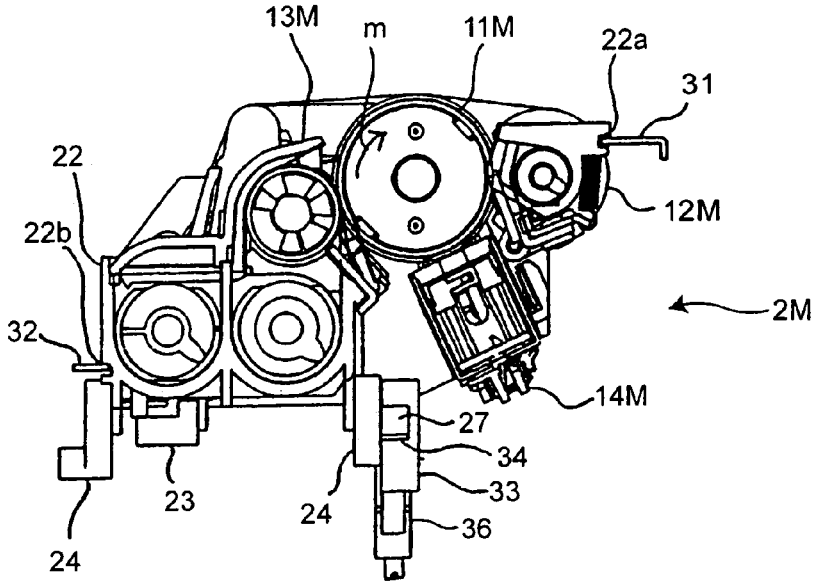
FIG. 4 is a schematic block diagram showing the magenta EPU mounted on the image forming unit of the embodiment of the present invention.

Hereafter, support leg 24 is inclined as shown in FIG. 10-4, and installation section 27*a* is guided in opposite area 34*a* and is pulled out outside the main body of the image forming apparatus. Support leg 24 avoids laser exposure device 50 for disturbing the path during passing opposite area 34*a* and passes the top thereof. Support leg 24 is inclined like this as shown in FIGS. 10-3 and 10-4, thus a wide space for passing of the support leg is not required around EPU 2M, and support leg can avoid easily laser exposure device 50, and EPU 2M can be pulled out easily in the direction of arrow s.

Next, when EPU 2M is pulled out outside the main body of the image forming apparatus and is raised as shown in FIG. 5-1, support legs 24 in the four corners of housing 22 can all swing and grounding section 27 is positioned downward by its own weight. When EPU 2M is put on workbench 30 in this state, as shown in FIG. 6-1, the load of housing 22 is applied to support legs 24, and as shown in FIG. 6-2, bracket 28 attached to housing 22 is fit into slit 26*a* of fitting hole 26 of support leg 24 and support leg 24 is fixed to housing 22.

At this time, between bottom 22*c* of housing 22 and workbench 30, a gap [$\partial$] is formed. Gap [$\partial$] is wider than thickness [$\mu$] of auto-toner sensor 23 projected from bottom 22*c* of housing 22, so that auto-toner sensor 23 can be prevented from touching workbench 30. Hereafter, on workbench 30, the maintenance necessary for EPU 2M is executed and after end of the maintenance, EPU 2M is mounted again on image forming unit 1.

When EPU 2M is raised from workbench 30 to mount EPU 2M on image forming unit 1, as shown in FIG. 5-1, support legs 24 are released from the load of housing 22 and can swing again. In this state, EPU 2M is mounted on image forming unit 1. Namely, first stay 31 and second stay 32 are inserted respectively through first slit 22*a* and second slit 22*b* and EPU 2M slides in the direction of arrow t as shown in FIG. 11-1 while supporting EPU 2M by first and second stays 31 and 32.

Figures 1, 11:
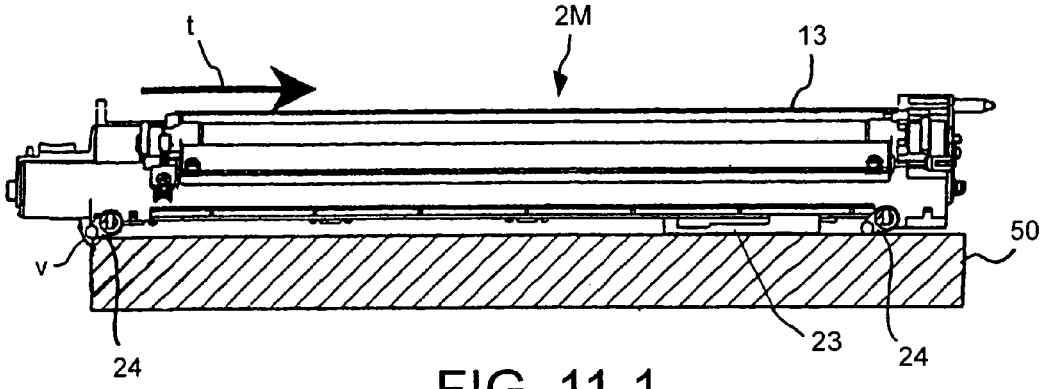
Figures 2, 11:
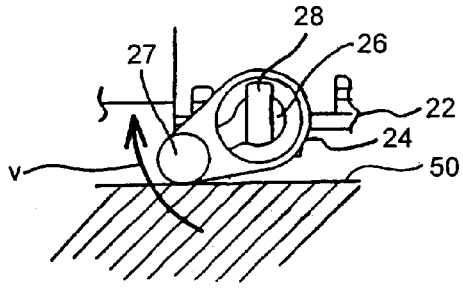

Left support leg 24 of EPU 2M shown in FIG. 1 does not interfere with laser exposure device 50, can swing, and in the state that grounding section 27 is positioned downward by its own weight, slides in the direction of arrow t as shown in FIG. 11-1. Right support legs 24*a* and 24*b* of EPU 2M shown in FIG. 1, when inserted into slit 34 of rail 33, are rotated in the direction of arrow v, are guided by rail 33 at the slope shown in FIG. 11-2, and slide in the direction of arrow t.

Next, grounding section 27*a* of right rear support leg 24*a* of EPU 2M shown in FIG. 1, when passing opposite area 34*a* of slit 34 and reaching rear area 34*b*, slowly moves down as shown in FIG. 10-5 along the shape of the level difference of rear area 34*b* of slit 34 and as shown in FIG. 10-6, reaches the lowest end of support leg 24.

Hereafter, EPU 2M further slides in the direction of arrow t and reaches the position shown in FIG. 7 where right rear grounding section 27*a* switches apparatus detection switch 36. When it is detected that apparatus detection switch 36 is switched by right rear grounding section 27*a* and EPU 2M is mounted on image forming unit 1, image forming unit 1 can perform the image forming operation.

Figure 12:
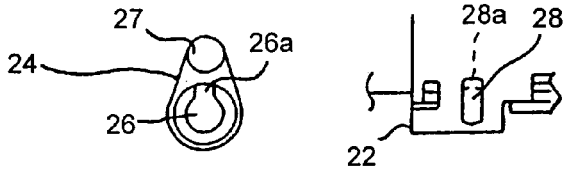
FIG. 12 is an illustration showing the state that the support leg of the embodiment of the present invention is mounted and demounted from the casing.

Further, support leg 24, by the following operation, is removed from casing 22 or attached to casing 22. EPUs 2Y, 2M, 2C and 2K are taken out outside the image forming apparatus, and then as shown in FIG. 12, support leg 24 is rotated in an 180° arc, and grounding section 27 is moved up. Stop section 28*a* projected from the top end of bracket 28 is pulled out from slit 26*a* of fitting hole 26 and support leg 24 is removed from bracket 28. Further, when attaching support leg 24 to bracket 28, support leg 24 is set in the direction shown in FIG. 12, and bracket 28 is inserted through fitting hole 26, thus support leg 24 is attached.

According to this embodiment, support leg 24 for casing 22 can swing in image forming unit 1, so that even if laser exposure device 50 disturbs the path of support leg 24 when inserting or removing EPUs 2Y, 2M, 2C and 2K from image forming unit 1, support leg 24 inclines and can avoid easily laser exposure device 50. Therefore, there is no need to widen the space for inserting support leg 24 around EPUs 2Y, 2M, 2C and 2K in image forming unit 1, thus the space can be reduced. Moreover, by installation of rail 33, support leg 24 can avoid smoothly laser exposure device 50. Furthermore, the level difference is formed in rear area 34*b* of slit 34 of rail 33 and the inclination of support leg 24 is inverted, so that support leg 24 can avoid more smoothly laser exposure device 50.

Further, the mounting of EPUs 2Y, 2M, 2C and 2K is detected by mounting detection switch 36, so that certainty of insertion and removal of EPUs 2Y, 2M, 2C and 2K can be obtained.

Furthermore, when putting EPUs 2Y, 2M, 2C and 2K on workbench 30 outside the main body of the image forming apparatus, support leg 24 is fixed to casing 22, thus although the space for support leg 24 when inserting or removing EPUs 2Y, 2M, 2C and 2K is reduced, gap [∂] between bottom 22*a* of casing 22 and workbench 30 can be reserved. Therefore, auto-toner sensor 23 can be prevented from damage due to touching workbench 30 or tools.

Further, the present invention is not limited to the embodiment aforementioned and within the scope of the present invention, can be modified variously. For example, the EPUs may have at least an image carrying member or at least a developing member. Further, the gap width between the bottom of the case member and the loading face when the case member is put on the loading face outside the main body of the image forming apparatus is not restricted.

Further, the detecting method of the detection member for detecting sure mounting of the case member on the main body of the image forming apparatus is optional such as mechanical or optical, and the installation position of the detection member is not restricted, and it is possible to install the detection member on the EPU side instead of the side of the main body of the image forming apparatus and when the EPUs are surely mounted on the main body of the image forming apparatus, to allow it to make contact with the rear frame and switch. Furthermore, the number of leg members attached to the case member and attaching position are not restricted. For example, when inserting or removing the EPUs, it is possible to install only the leg member of the part requiring to avoid a downward structural body so as to swing and install fixed legs for the parts requiring no avoidance.

As described above in detail, according to the present invention, the leg member of the case member can swing, so that when inserting or removing the EPUs from the main body of the image forming apparatus, the space for inserting the leg member can be reduced and the space around the EPUs can be reduced. Further, when putting the EPUs outside the main body of the image forming apparatus, the leg member can be fixed easily, and a necessary gap can be reserved between the bottom of the case member and the loading face, and the structural body on the bottom of the case member can be protected.

What is claimed is:

1. An electro-photographic process unit comprising:

an image carrying member on which a toner image is formed;

a case member removably attached to a main body of an image forming apparatus to support the image carrying member; and at least one leg member provided on the case member, rotatable when the case member is mounted in the main body of the image forming apparatus and fixed when the case member is put on a loading face outside the main body of the image forming apparatus, to support the case member.

2. The electro-photographic process unit according to claim 1, wherein the leg member fixed when the case member is put on the loading face forms a desired gap between a bottom of the case member and the loading face.

3. The electro-photographic process unit according to claim 2, wherein the case member further supports a developing member to supply toner to a latent image on the image carrying member and the gap is set at least to a thickness of a density detection member provided on a bottom of the developing member.

4. The electro-photographic process unit according to claim 1, wherein:

the leg member has a fitting hole swingably fit into a mounting member fixed to the case member and a grounding section in contact with the loading face, the leg member can slide on the mounting member in parallel with the gravity when the grounding section is positioned down by its own weight, and the fitting hole has a slit fit into the mounting member when the leg member slides on the mounting member in parallel with the gravity.

5. The electro-photographic process unit according to claim 4, wherein if the case member is put on the loading face when the grounding section is positioned down by its own weight, the leg member slides on the mounting member in parallel with the gravity by a load of the case member and the mounting member is fit into the slit.

6. The electro-photographic process unit according to claim 4, wherein the leg member can be inserted and removed from the mounting member when the grounding section is rotated at an angle of 180° with the gravity.

7. The electro-photographic process unit according to claim 4, wherein the grounding section is fit into a guide member on the side of the main body of the image forming apparatus and swings when moving the case member inside the main body of the image forming apparatus.

8. The electro-photographic process unit according to claim 1, wherein the case member further supports a charging member to uniformly charge the image carrying member, a developing member to supply toner to a latent image on the image carrying member, and a cleaning member to remove residual toner on the image carrying member.

9. The electro-photographic process unit according to claim 1, wherein the case member has a detection member to detect mounting on the main body of the image forming apparatus.

10. An electro-photographic process unit comprising:

a developing member to supply toner to a latent image on an image carrying member;

a case member removably attached to a main body of an image forming apparatus to support the developing member; and at least one leg member provided on the case member, swingable when the case member is mounted in the main body of the image forming apparatus and fixed when the case member is put on a loading face outside the main body of the image forming apparatus, to support the case member.

11. The electro-photographic process unit according to claim 10, wherein the leg member fixed when the case member is put on the loading face forms a desired gap between a bottom of the case member and the loading face.

12. The electro-photographic process unit according to claim 11, wherein the gap is set at least to a thickness of a density detection member provided on a bottom of the developing member.

13. The electro-photographic process unit according to claim 10, wherein:

the leg member has a fitting hole swingably fit into a mounting member fixed to the case member and a grounding section in contact with the loading face, the leg member can slide on the mounting member in parallel with the gravity when the grounding section is positioned down by its own weight, and the fitting hole has a slit fit into the mounting member when the leg member slides on the mounting member in parallel with the gravity.

14. The electro-photographic process unit according to claim 13, wherein if the case member is put on the loading face when the grounding section is positioned down by its own weight, the leg member slides on the mounting member in parallel with the gravity by a load of the case member and the mounting member is fit into the slit.

15. The electro-photographic process unit according to claim 13, wherein the leg member can be inserted and removed from the mounting member when the grounding section is rotated at an angle of 180° with the gravity.

16. The electro-photographic process unit according to claim 13, wherein the grounding section is fit into a guide member on the side of the main body of the image forming apparatus and swings when moving the case member inside the main body of the image forming apparatus.

17. The electro-photographic process unit according to claim 10, wherein the case member further supports the image carrying member, a charging member to uniformly charge the image carrying member, and a cleaning member to remove residual toner on the image carrying member.

18. The electro-photographic process unit according to claim 10, wherein the case member has a detection member to detect mounting on the main body of the image forming apparatus.

19. An image forming apparatus comprising:

a body frame;

an electro-photographic process unit removably attached to the body frame including a case member to suppor an image carrying member and at least one leg member provided on the case member, swingable when the case member is mounted in the body frame and fixed when the case member is put on a loading face outside the body frame, to support the case member; and an image forming mechanism to form a toner image on the image carrying member.

20. The image forming apparatus according to claim 19, further comprising a mounting detection member to detect that the electro-photographic process unit is mounted in the body frame.

21. The image forming apparatus according to claim 20, wherein the mounting detection member is arranged on a rear side of the body frame and detects the case member mounted in the body frame.

22. The image forming apparatus according to claim 19, wherein the leg member fixed when the case member is put on the loading face forms a desired gap between a bottom of the case member and the loading face.

23. The image forming apparatus according to claim 19, wherein the case member further supports a developing member to supply toner to a latent image on the image carrying member and the gap is set at least to a thickness of a density detection member provided on a bottom of the developing member.

24. The image forming apparatus according to claim 19, wherein:

the leg member has a fitting hole swingably fit into a mounting member fixed to the case member and a grounding section in contact with the loading face, the leg member can slide on the mounting member in parallel with the gravity when the grounding section is positioned down by its own weight, and the fitting hole has a slit fit into the mounting member when the leg member slides on the mounting member in parallel with the gravity.

25. The image forming apparatus according to claim 24, wherein if the case member is put on the loading face when the grounding section is positioned down by its own weight, the leg member slides on the mounting member in parallel with the gravity by a load of the case member and the mounting member is fit into the slit.

26. The image forming apparatus according to claim 24, wherein the body frame has a rail to guide the leg member while swinging.

27. The image forming apparatus according to claim 19, wherein the case member of the electro-photographic process unit further supports a charging member to uniformly charge the image carrying member, a developing member to supply toner to a latent image on the image carrying member, and a cleaning member to remove residual toner on the image carrying member.

28. An image forming apparatus comprising:

a body frame;

an image carrying member on which a toner image is formed;

an electro-photographic process unit removably attached to the body frame including a case member to support a developing member to supply toner to a latent image on the image carrying member and at least one leg member provided on the case member, swingable when the case member is mounted in the body frame and fixed when the case member is put on a loading face outside the body frame, to support the case member; and an image forming mechanism to form the toner image on the image carrying member.

29. The image forming apparatus according to claim 28, further comprising a mounting detection member to detect that the electro-photographic process unit is mounted in the body frame.

30. The image forming apparatus according to claim 29, wherein the mounting detection member is arranged on a rear side of the body frame and detects the case member mounted in the body frame.

31. The image forming apparatus according to claim 28, wherein the leg member fixed when the case member is put on the loading face forms a desired gap between a bottom of the case member and the loading face.

32. The image forming apparatus according to claim 31, wherein the gap is set at least to a thickness of a density detection member installed on a bottom of the developing member.

33. The image forming apparatus according to claim 28, wherein:

the leg member has a fitting hole swingably fit into a mounting member fixed to the case member and a grounding section in contact with the loading face, the leg member can slide on the mounting member in parallel with the gravity when the grounding section is positioned down by its own weight, and the fitting hole has a slit fit into the mounting member when the leg member slides on the mounting member in parallel with the gravity.

34. The image forming apparatus according to claim 33, wherein if the case member is put on the loading face when the grounding section is positioned down by its own weight, the leg member slides on the mounting member in parallel with the gravity by a load of the case member and the mounting member is fit into the slit.

35. The image forming apparatus according to claim 33, wherein the body frame has a rail to guide the leg member while swinging.

36. The image forming apparatus according to claim 28, wherein the case member of the electro-photographic process unit further supports the image carrying member, a charging member to uniformly charge the image carrying member, and a cleaning member to remove residual toner on the image carrying member.

* * * * *